US012329206B2

(12) United States Patent
Chen et al.

(10) Patent No.: US 12,329,206 B2
(45) Date of Patent: Jun. 17, 2025

(54) ATOMIZING ASSEMBLY AND ATOMIZING DEVICE

(71) Applicant: Shenzhen Transpring Technology Co., Ltd., Guangdong (CN)

(72) Inventors: Chuhui Chen, Guangdong (CN); Tao Pu, Guangdong (CN)

(73) Assignee: SHENZHEN TRANSPRING TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 18/013,992

(22) PCT Filed: Jun. 9, 2022

(86) PCT No.: PCT/CN2022/097950

§ 371 (c)(1),
(2) Date: Dec. 30, 2022

(87) PCT Pub. No.: WO2023/029642

PCT Pub. Date: Mar. 9, 2023

(65) Prior Publication Data

US 2024/0090580 A1 Mar. 21, 2024

(30) Foreign Application Priority Data

Sep. 6, 2021 (CN) ..... 202122142917.3

(51) Int. Cl.
*A24F 40/485* (2020.01)
*A24F 40/10* (2020.01)
*A24F 40/42* (2020.01)

(52) U.S. Cl.
CPC ..... *A24F 40/485* (2020.01); *A24F 40/10* (2020.01); *A24F 40/42* (2020.01)

(58) Field of Classification Search
CPC ..... A24F 40/485; A24F 40/10; A24F 40/42
See application file for complete search history.

(56) References Cited

U.S. PATENT DOCUMENTS

2015/0257446 A1* 9/2015 Chung ..... A24F 1/30 131/329
2019/0230986 A1* 8/2019 Zinovik ..... A24F 40/485

FOREIGN PATENT DOCUMENTS

CN 204994614 U 1/2016
CN 205757179 U 12/2016
(Continued)

*Primary Examiner* — Michael H. Wilson
*Assistant Examiner* — Jennifer A Kessie
(74) *Attorney, Agent, or Firm* — Scully, Scott, Murphy & Presser, P.C.

(57) ABSTRACT

An atomizing assembly and an atomizing device are provided in the disclosure. The atomizing assembly is configured to atomize liquid to-be-atomized and includes an oil cup, an atomizer, an opening-closing member, and a suction nozzle. The oil cup is configured to store the liquid to-be-atomized. The atomizer is disposed in the oil cup and configured to atomize the liquid to-be-atomized. The atomizer includes an atomizing rod and an atomizing core disposed in the atomizing rod. The opening-closing member covers one end of the atomizing rod away from a bottom of the oil cup and has a closed state and an open state. The suction nozzle slidably covers the oil cup. The suction nozzle extends through the opening-closing member when the suction nozzle moves toward the oil cup, such that the opening-closing member is in the open state, and the suction nozzle communicates with the atomizing rod.

18 Claims, 10 Drawing Sheets

(56) References Cited

FOREIGN PATENT DOCUMENTS

| | | | |
|---|---|---|---|
| CN | 205813571 | U | 12/2016 |
| CN | 207125318 | U | 3/2018 |
| CN | 111109656 | A | 5/2020 |
| CN | 210471016 | U | 5/2020 |
| CN | 211407645 | U | 9/2020 |
| CN | 215775562 | U | 2/2022 |

* cited by examiner

ATOMIZING ASSEMBLY AND ATOMIZING DEVICE

CROSS-REFERENCE TO RELATED APPLICATIONS

The present application is a national phase entry of PCT International Application No. PCT/CN2022/097950, filed on Jun. 9, 2022, which claims priority to Chinese Patent Application No. 202122142917.3, filed on Sep. 6, 2021. The disclosures of PCT International Application No. PCT/CN2022/097950 and Chinese Patent Application No. 202122142917.3 are incorporated herein by reference in their entirety as part of the present application.

TECHNICAL FIELD

This disclosure relates to the field of atomizing technology, particularly to an atomizing assembly and an atomizing device.

BACKGROUND

Atomizing devices are more and more widely used in modern life. With the continuous development of atomizing devices, the atomizing devices such as medical atomizers, household atomizers, humidifiers, and micro atomizers have found increasingly popular utilizations.

An atomizing assembly of an atomizing device on the market today has an oil cup and a suction nozzle that are separated from each other. When injecting oil into the atomizing assembly, the suction nozzle or an oil plug needs to be fully opened, so that liquid to-be-atomized can be injected into the oil cup. When oil injection into the atomizing assembly is accomplished, the suction nozzle or the oil plug needs to be covered on or plugged into the oil cup again. As such, oil injection is cumbersome for users during use, which adversely affects the user experience.

Therefore, how to design an atomizing assembly and an atomizing device with simple oil injection has become an urgent technical problem.

SUMMARY

An atomizing assembly and an atomizing device with simple oil injection are provided in the disclosure.

In an aspect, an atomizing assembly is provided in the disclosure and configured to atomize liquid to-be-atomized. The atomizing assembly includes an oil cup, an atomizer, an opening-closing member, and a suction nozzle. The oil cup is configured to store the liquid to-be-atomized. The atomizer is disposed in the oil cup and configured to atomize the liquid to-be-atomized, and the atomizer includes an atomizing rod and an atomizing core disposed in the atomizing rod. The opening-closing member covers one end of the atomizing rod away from a bottom of the oil cup and has a closed state and an open state. The suction nozzle slidably covers the oil cup. The suction nozzle extends through the opening-closing member when the suction nozzle moves toward the oil cup, so that the opening-closing member is in the open state, and the suction nozzle communicates with the atomizing rod. The suction nozzle is drawn out of the opening-closing member when the suction nozzle moves away from the oil cup, so that the opening-closing member is in the closed state, and the suction nozzle communicates with the oil cup.

In a possible implementation, the opening-closing member has a seam and is elastic at the seam, the opening-closing member is in the open state when the suction nozzle extends through the seam, and the seam is closed under an elastic restoring force and the opening-closing member is in the closed state when the suction nozzle is drawn out through the seam.

In a possible implementation, the opening-closing member has a bottom wall and a peripheral side wall connected with the bottom wall at a periphery of a side of the bottom wall, the bottom wall covers an opening of the atomizing rod away from the bottom of the oil cup, the peripheral side wall is sleeved on a side wall of the atomizing rod, the opening-closing member is in the open state when the suction nozzle extends through the bottom wall into the atomizing rod, and the opening-closing member is in the closed state when the suction nozzle is drawn out of the atomizing rod.

In a possible implementation, the atomizing assembly further includes a cushion fixedly connected with a side of the suction nozzle close to the opening-closing member, a side of the cushion away from the suction nozzle abuts against the opening-closing member when the suction nozzle extends through the seam, and the side of the cushioning away from the suction nozzle is spaced apart from the opening-closing member when the suction nozzle is drawn out of the opening-closing member.

In a possible implementation, the suction nozzle includes a main body and a connecting portion connected with one side of the main body, the main body covers the oil cup, the connecting portion is sleeved on an outer periphery of the oil cup, and the cushion is disposed in the connecting portion and fixed at one side of the main body close to the connecting portion.

In a possible implementation, the connecting portion defines an air channel, the air channel extends through the main body, the main body is provided with a protrusion at the one side of the main body close to the connecting portion, the protrusion is received in the connecting portion and communicates with the air channel. The opening-closing member is in the open state when the protrusion extends into the atomizing rod through the seam, and the air channel communicates with the atomizing rod. The opening-closing member is in the closed state when the protrusion is drawn out through the seam, the protrusion is spaced apart from the bottom wall, and the air channel communicates with the oil cup.

In a possible implementation, the oil cup includes a main body and a connecting portion received in the main body and dividing the main body into a first receiving cavity and a second receiving cavity, the first receiving cavity is configured to receive the liquid to-be-atomized. The connecting portion defines a through hole, and the atomizing rod has one end received and fixed in the through hole and the other end received in the first receiving cavity.

In a possible implementation, the atomizing assembly further includes a base and an electrode. The base is received and fixed in the second receiving cavity. The base defines an electrode hole, and the electrode extends through the electrode hole and is electrically connected with the atomizing core.

In a possible implementation, the atomizing assembly further includes a fixing sleeve sleeved on one end of the oil cup away from the suction nozzle. The fixing sleeve defines a communicating hole facing the electrode hole, and the base is partially received in the communicating hole.

In another aspect, an atomizing device is further provided in the disclosure. The atomizing device includes the atomizing assembly and a power supply assembly. The power supply assembly is electrically connected with the atomizing assembly to power the atomizing assembly.

For the atomizing assembly provided in the disclosure, the suction nozzle moves away from the oil cup to be out of the opening-closing member when an oil injection into the atomizing assembly is needed, such that the opening-closing member is in the closed state, and the suction nozzle communicates with the oil cup, and thus liquid to-be-atomized can be directly injected into the oil cup via the suction nozzle. The suction nozzle moves toward the oil cup to penetrate the opening-closing member when the oil injection into the atomizing assembly is accomplished, such that the opening-closing member is in the open state, and the suction nozzle communicates with the atomizing rod, and thus atomized gas in the atomizing rod can be sucked normally by a user. An oil injecting channel and anatomizing channel are integrally formed, such that on the one hand, the oil injection of the atomizing assembly and the atomizing device can be more convenient, and on the other hand, the atomizing assembly is integrated as a whole as leaving the factory, thereby reducing a packaging cost of the atomizing assembly and a loss of components and thus reducing production costs of the atomizing assembly and the atomizing device.

BRIEF DESCRIPTION OF THE DRAWINGS

To describe the technical solutions in the implementations of the disclosure more clearly, the following briefly introduces the accompanying drawings required for describing the implementations. Apparently, the accompanying drawings in the following description illustrate some implementations of the disclosure. Those of ordinary skill in the art may also obtain other drawings based on these accompanying drawings without creative efforts.

DETAILED DESCRIPTION

The technical solutions in the implementations of the disclosure are clearly and completely described in the following with reference to the accompanying drawings in the implementations of the disclosure to make those skilled in the art better understand the technical solutions of the disclosure. Apparently, the described implementations are merely part rather than all of the implementations of the disclosure. All other implementations obtained by those of ordinary skill in the art based on the implementations of the disclosure without creative efforts are within the scope of the disclosure.

Figure 1:
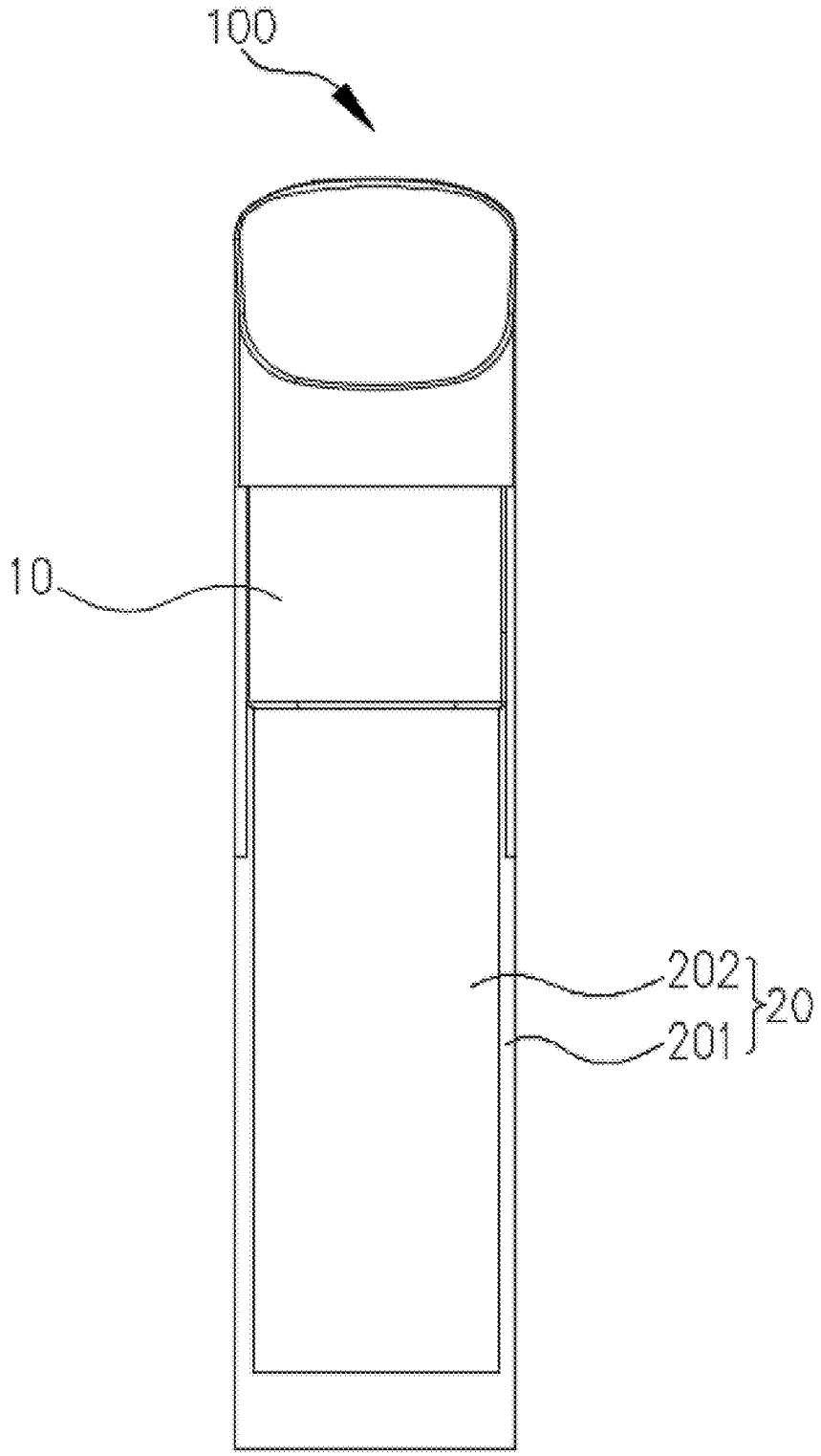
FIG. 1 is a schematic view of an atomizing device provided in implementations of the disclosure.

Referring to FIG. 1, FIG. 1 is a schematic view of an atomizing device provided in implementations of the disclosure.

An atomizing device 100 includes an atomizing assembly 10 and a power supply assembly 20. The power supply assembly 20 is configured to power the atomizing assembly 10, such that the atomizing assembly 10 can atomize liquid to-be-atomized, and thus atomization can be achieved by the atomizing device 100.

The power supply assembly 20 includes a sleeve 201 and a cell 202 disposed in the sleeve 201. The sleeve 201 is fixedly connected with the atomizing assembly 10 to make structure of the atomizing device 100 more stable. The cell 202 is electrically connected with the atomizing assembly 10 to power the atomizing assembly 10.

Optionally, the sleeve 201 may be fixedly connected with the atomizing assembly 10 by, but not limited to, threaded connection, snap connection, and interference fit connection.

Optionally, the atomizing device 100 includes, but is not limited to, medical atomizers, household atomizers, humidifiers, micro atomizers, etc.

Figure 2:
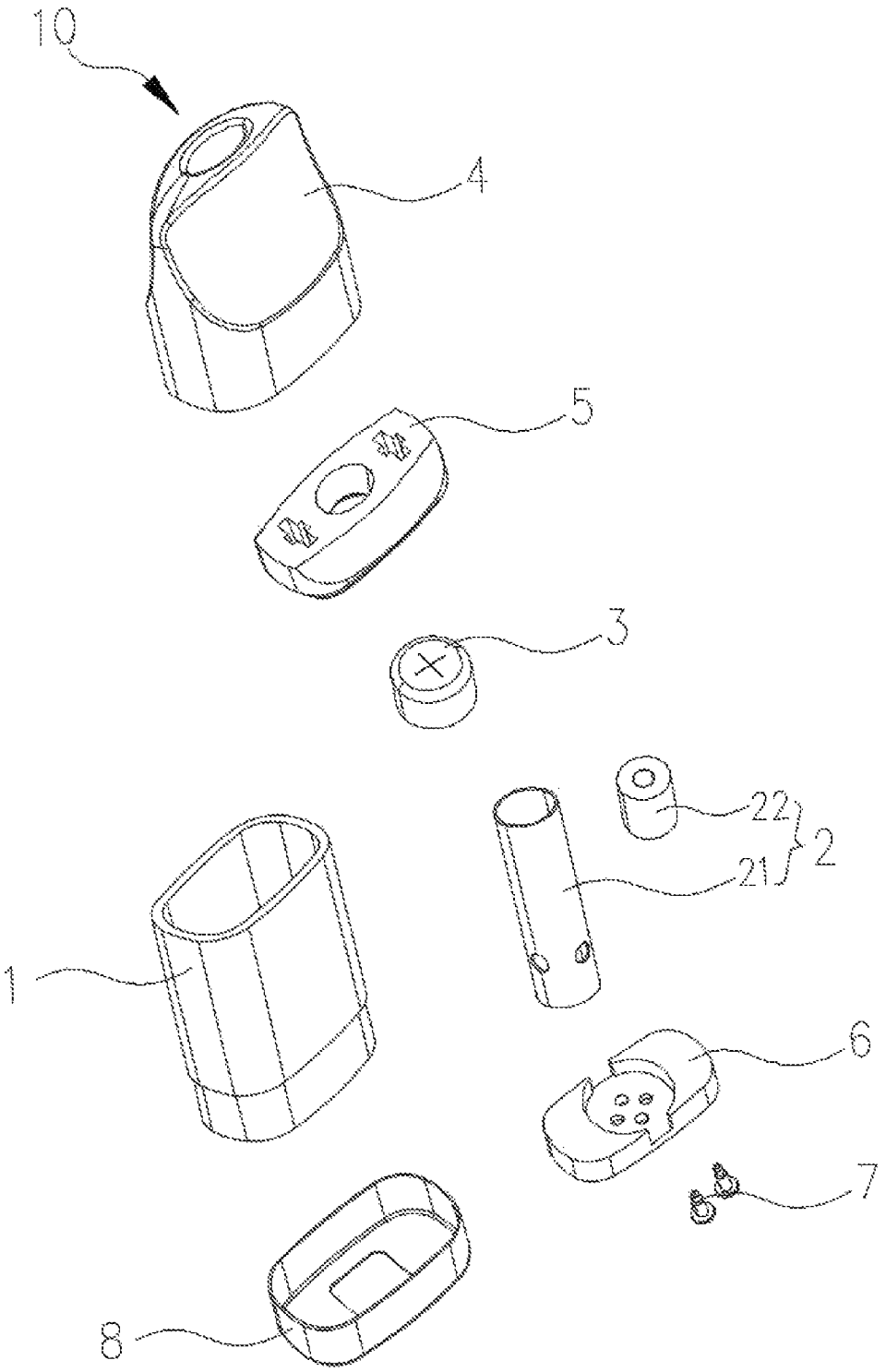
FIG. 2 is an exploded view of an atomizing assembly provided in implementations of the disclosure.
Figure 3:
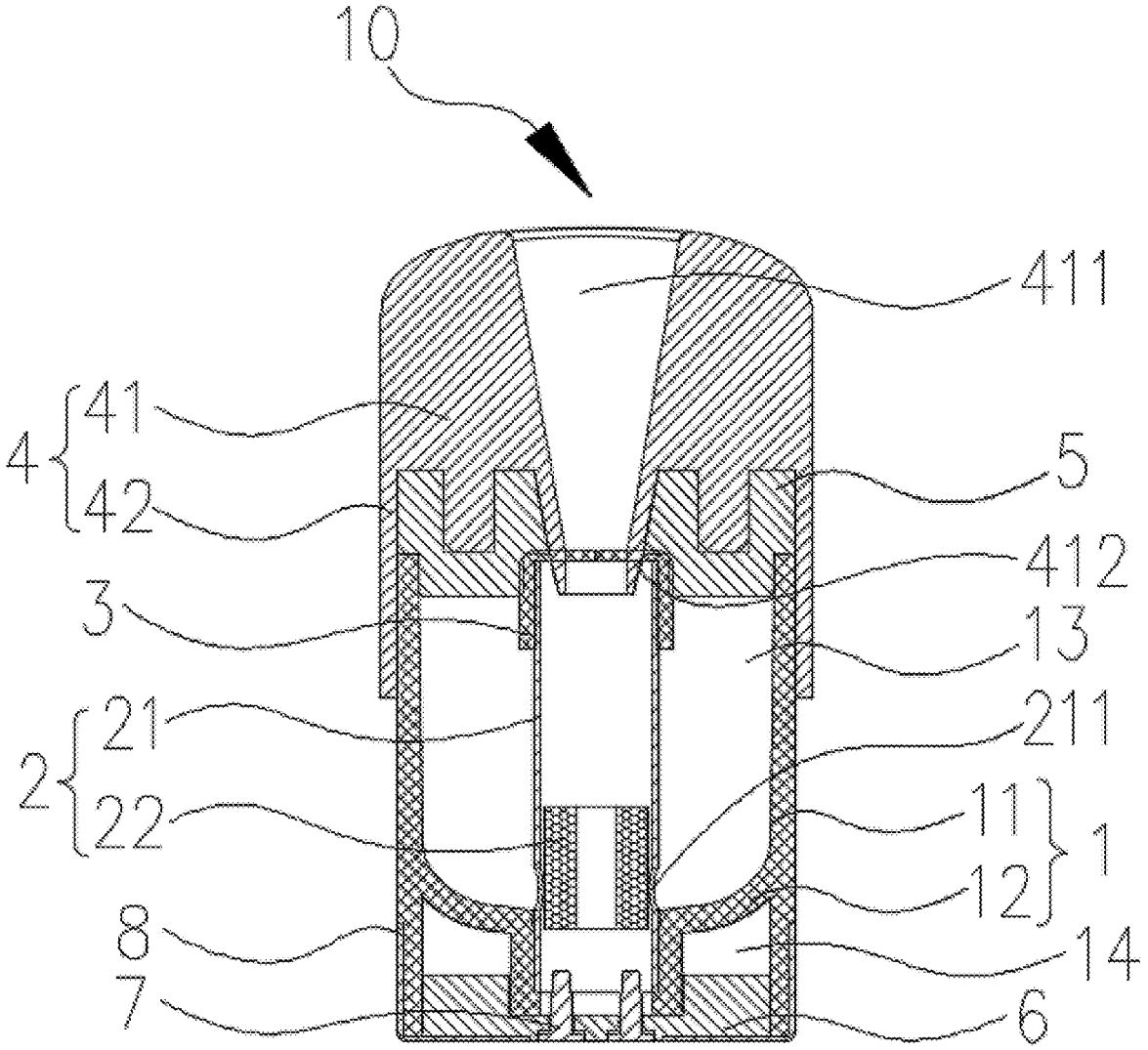
FIG. 3 is a cross-sectional view of an atomizing assembly after oil injection provided in implementations of the disclosure.
Figure 4:
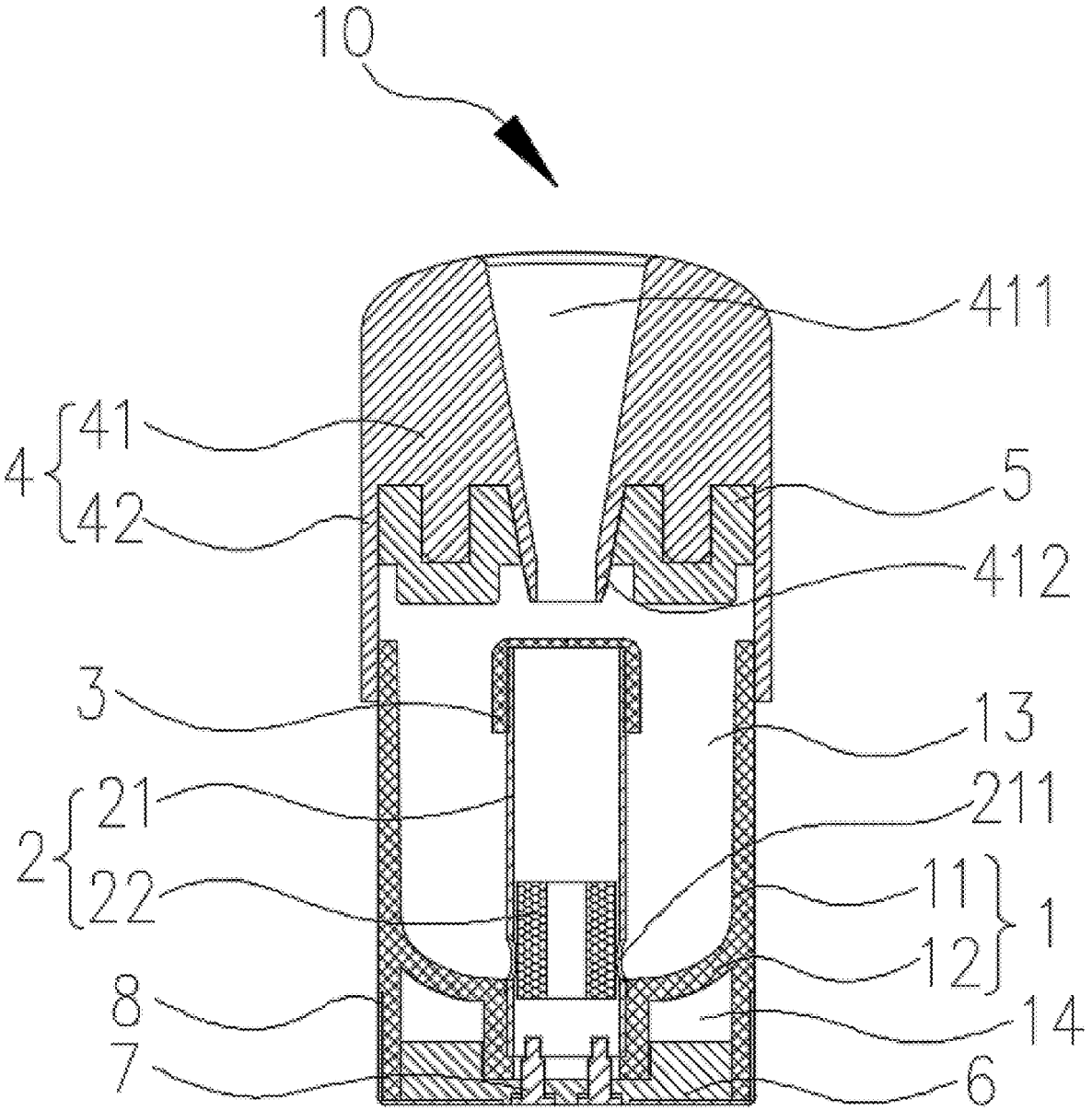
FIG. 4 is a cross-sectional view of an atomizing assembly during oil injection provided in implementations of the disclosure.

Referring to FIG. 2, FIG. 3, and FIG. 4, FIG. 2 is an exploded view of an atomizing assembly provided in implementations of the disclosure, FIG. 3 is a cross-sectional view of an atomizing assembly after oil injection provided in implementations of the disclosure, and FIG. 4 is a cross-sectional view of an atomizing assembly during oil injection provided in implementations of the disclosure.

The atomizing assembly 10 includes an oil cup 1, an atomizer 2, an opening-closing member 3, a suction nozzle 4, a cushion 5, a base 6, a fixing sleeve 8, and an electrode 7. The oil cup 1 is configured to store the liquid to-be-atomized. The atomizer 2 is disposed in the oil cup 1 and configured to atomize the liquid to-be-atomized. The opening-closing member 3 is sleeved on one end of the atomizer 2 away from a bottom of the oil cup 1 and configured to communicate the suction nozzle 4 with the atomizer 2 or separate the suction nozzle 4 from the atomizer 2. The suction nozzle 4 is sleeved on one end of the oil cup 1 away from the bottom of the oil cup 1, such that atomized gas generated in the atomizer 2 can be suck by a user. The cushion 5 is fixed at an end of the suction nozzle 4 close to the oil cup 1. The base 6 is disposed in the oil cup 1 and located at an end of the oil cup 1 away from the suction nozzle 4. The electrode 7 extends through the base 6 and electrically connected with the atomizer 2. The fixing sleeve 8 is sleeved on an end of the oil cup 1 away from the suction nozzle 4.

Figure 5:
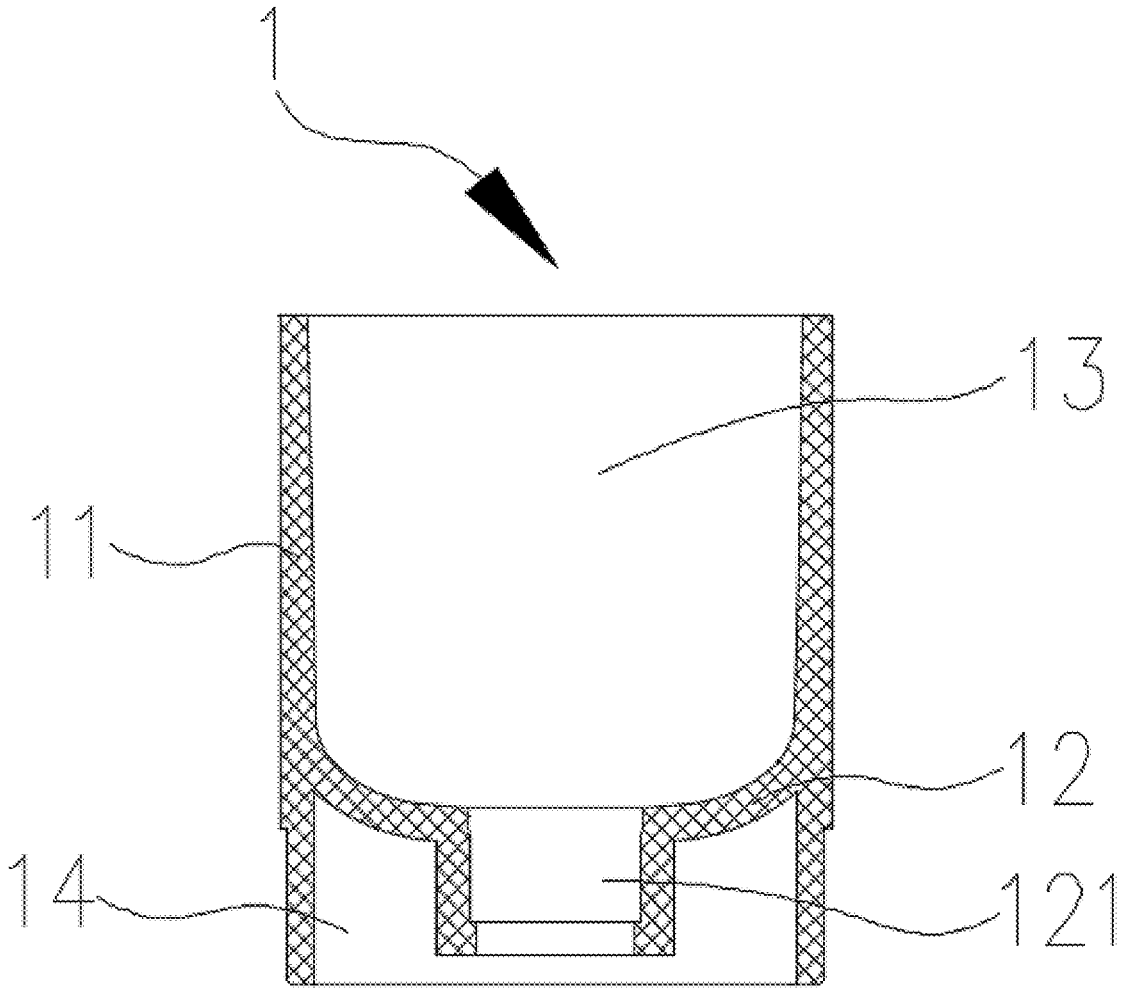
FIG. 5 is a cross-sectional view of an oil cup provided in implementations of the disclosure.

Referring to FIG. 5, FIG. 5 is a cross-sectional view of an oil cup provided in implementations of the disclosure.

The oil cup 1 includes a main body 11 and a connecting portion 12. The connecting portion 12 divides the main body 11 into a first receiving cavity 13 and a second receiving cavity 14. The connecting portion 12 defines a through hole 121 communicating the first receiving cavity 13 and the second receiving cavity 14. The first receiving cavity 13 is configured to store the liquid to-be-atomized.

Figure 6:
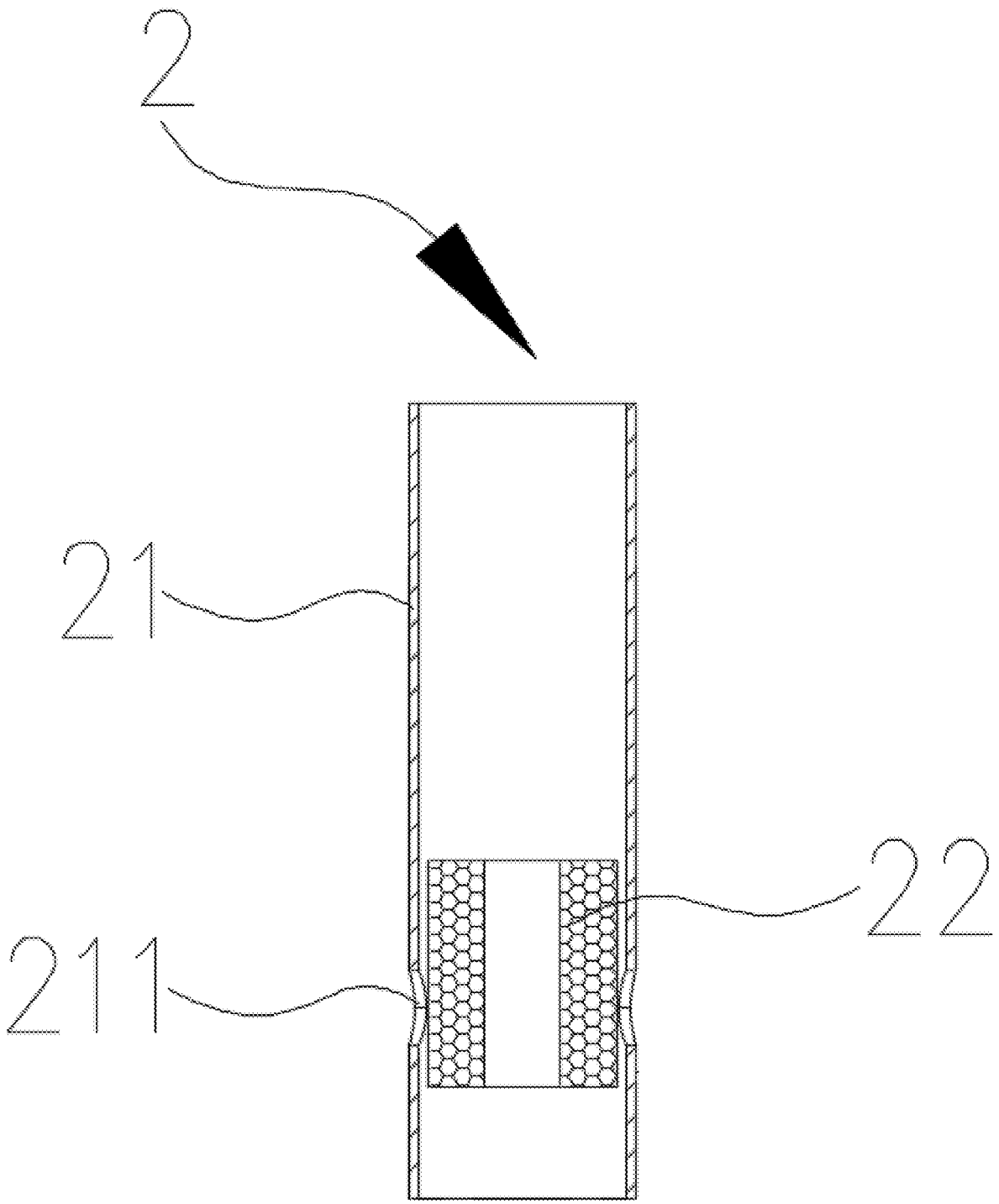
FIG. 6 is a cross-sectional view of an atomizer provided in implementations of the disclosure.

Referring to FIG. 3 and FIG. 6, FIG. 6 is a cross-sectional view of an atomizer provided in implementations of the disclosure.

The atomizer 2 is received in the first receiving cavity 13 of the oil cup 1 and includes an atomizing rod 21 and an atomizing core 22 disposed in the atomizing rod 21. The atomizing rod 21 is hollow, and has one end extending into and fixed in the through hole 121 of the connecting portion 12. The atomizing core 22 is fixed in the atomizing rod 21 and configured to atomize the liquid to-be-atomized. The atomizing rod 21 defines at least one oil guiding hole 211 penetrating through the atomizing rod 21 in a radial direction of the atomizing rod 21. The oil guiding hole 211 communicates the atomizing rod 21 and the first receiving cavity 13, such that the liquid to-be-atomized in the first receiving cavity 13 can flow through the oil guiding hole 211 into the atomizing rod 21, such that the liquid to-be-atomized can contact the atomizing core 22 in the atomizing rod 21, and thus the liquid to-be-atomized can be heated to atomize by the atomizing core 22, and thereby realizing atomization of the atomizing assembly 10.

Figure 7:
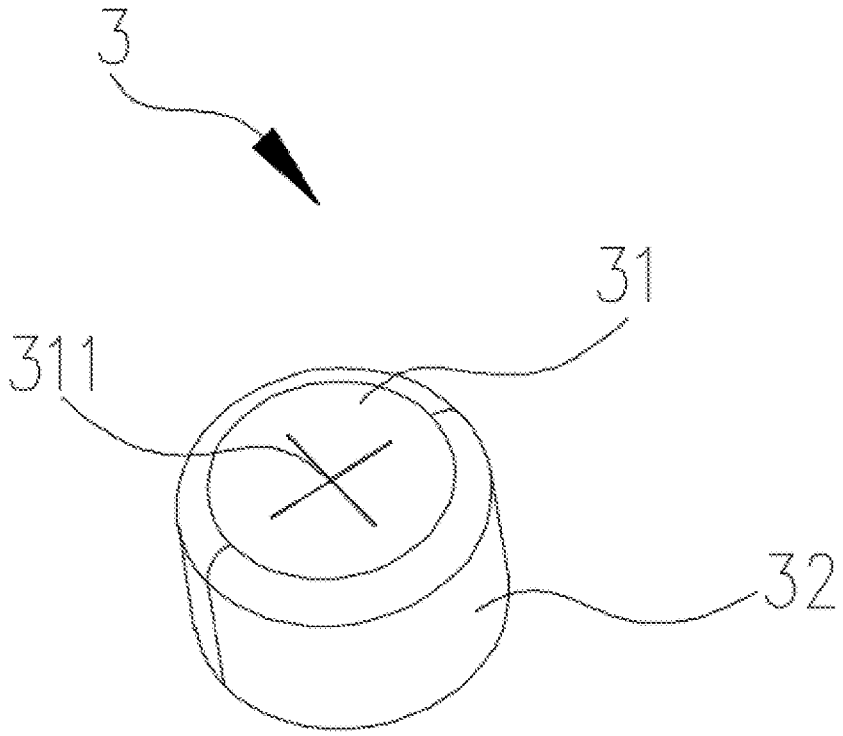
FIG. 7 is a schematic structural view of an opening-closing member provided in implementations of the disclosure.
Figure 8:
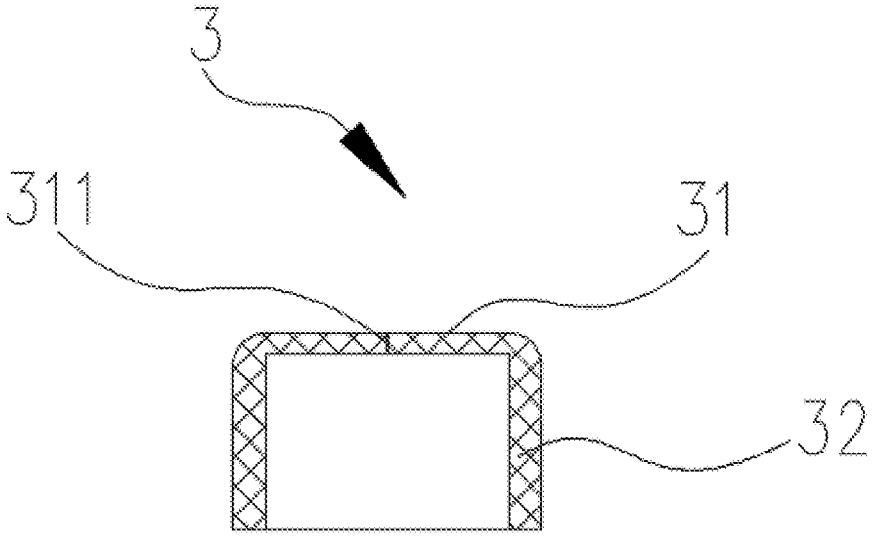
FIG. 8 is a cross-sectional view of an opening-closing member provided in implementations of the disclosure.

Referring to FIG. 3, FIG. 4, FIG. 7, and FIG. 8, FIG. 7 is a schematic structural diagram of an opening-closing member provided in implementations of the disclosure, and FIG. 8 is a cross-sectional view of an opening-closing member provided in implementations of the disclosure.

The opening-closing member 3 is sleeved on an end of the atomizing rod 21 away from the connecting portion 12. The opening-closing member 3 has a bottom wall 31 and a peripheral side wall 32 connected with the bottom wall 31 at a periphery of a side of the bottom wall, and the peripheral side wall 32 is in a shape of annular tube. The bottom wall 31 covers an opening defined at the end of the atomizing rod 21 away from the connecting portion 12, and the peripheral side wall 32 is sleeved on a side wall of the end of the atomizing rod 21 away from the connecting portion 12. The bottom wall 31 has a seam 311 penetrating the bottom wall 31. The opening-closing member 3 has a closed state and an open state. The seam 311 on the bottom wall 31 is closed when the opening-closing member 3 is in the closed state. The seam 311 on the bottom wall 31 is open when the opening-closing member 3 is in the open state.

Optionally, the opening-closing member 3 may be made of a material that includes, but is not limited to, silicone, or other soft materials.

Optionally, the seam 311 may be in a shape of that includes, but is not limited to, double cross, cross, Romanic number "1" lying sideway, and other shapes.

In other implementations, the opening-closing member 3 may include only the bottom wall 31 sealingly covering the opening of the atomizing rod 21 away from the connecting portion 12.

Figure 9:
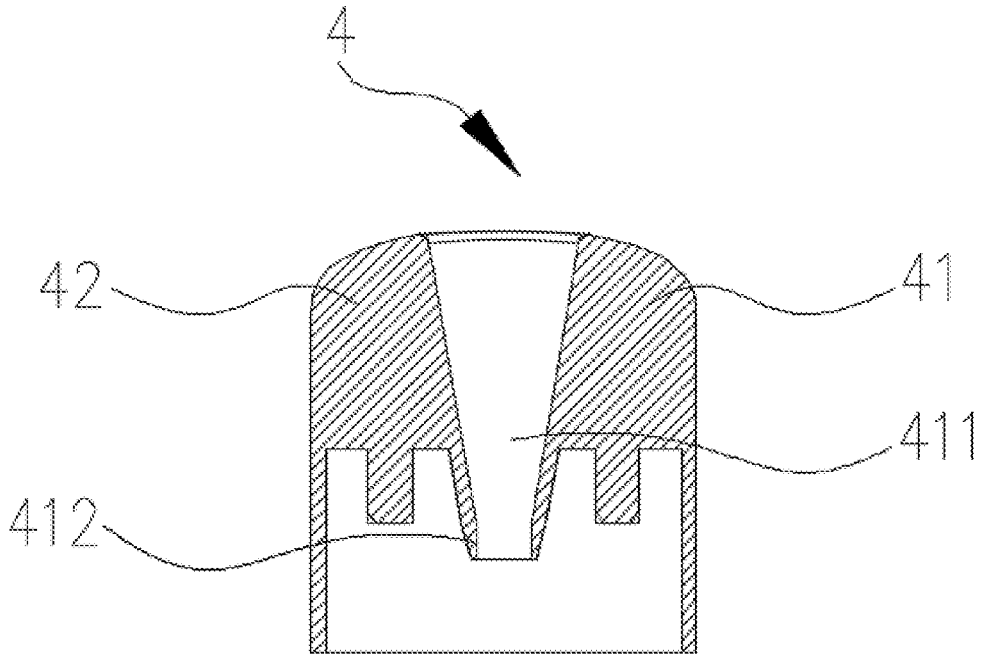
FIG. 9 is a cross-sectional view of a suction nozzle provided in implementations of the disclosure.

Referring to FIG. 9, FIG. 9 is a cross-sectional view of a suction nozzle provided in implementations of the disclosure.

The suction nozzle 4 includes a main body 41 and a connecting portion 42 connected with one end of the main body 41. The main body 41 defines an air channel 411, and the air channel 411 extends through the main body 411. The connecting portion 42 is annular. One end of the connecting portion 42 is sealingly connected with a periphery of the main body 41, and the air channel 411 communicates with a cavity of the connecting portion 42. One end of the connecting portion 42 away from the main body 41 is sleeved on an outer periphery of the oil cup 1 at an end of the oil cup 1 where an opening of the first receiving cavity 13 is located. The suction nozzle 4 of the air channel 411 has a protrusion 412 protruding at an end of the main body 41 close to the connecting portion 42, and the protrusion 412 communicates with the air channel 411.

Referring to FIG. 3 and FIG. 7, the seam 311 of the bottom wall 31 is open and the air channel 411 communicates with the atomizing rod 21 when the protrusion 412 penetrates the seam 311 of the bottom wall 31 of the opening-closing member 3, and at this moment, the opening-closing member 3 is in the open state.

When the suction nozzle 4 moves toward the opening-closing member 3, the protrusion 412 of the air channel 411 of the suction nozzle 4 penetrates the seam 311 of the bottom wall 31 of the opening-closing member 3, such that the seam 311 of the bottom wall 31 is open, and thus the air channel 411 communicates with the atomizing rod 21. The atomizing core 22 in the atomizing rod 21 can atomize the liquid to-be-atomized to be atomized gas, such that the atomized gas in the atomizing rod 21 can be sucked by the user via the air channel 411 of the suction nozzle 4.

Referring to FIG. 4 and FIG. 7, when the protrusion 412 is drawn out through the seam 311 of the bottom wall 31 of the opening-closing member 3, the seam 311 of the bottom wall 31 is closed, the air channel 411 communicates with the first receiving cavity 13 of the oil cup 1, and at this moment, the opening-closing member 3 is in the closed state.

When the suction nozzle 4 moves away from the opening-closing member 3, the protrusion 412 of the air channel 411 of the suction nozzle 4 is drawn out through the seam 311 of the bottom wall 31 of the opening-closing member 3, the seam 311 of the bottom wall 31 is closed, and the air channel 411 communicates with the first receiving cavity 13 of the oil cup 1. When the oil cup 1 needs to be injected the liquid to-be-atomized, the liquid to-be-atomized can be injected by the user via the air channel 411, and the liquid to-be-atomized enters the first receiving cavity 13 of the oil cup 1 via the air channel 411.

Referring to FIG. 3, FIG. 4, and FIG. 7, the suction nozzle 4 can move to communicate with the atomizing rod 21 or the oil cup 1. The suction nozzle 4 communicates with the oil cup 1 when the opening-closing member 3 is in the closed state, such that the liquid to-be-atomized can be injected to the oil cup 1 by a user via the air channel 411. The suction nozzle 4 communicates with the atomizing rod 21 when the opening-closing member 3 is in the open state, such that the atomized gas in the atomizing rod 21 can be sucked by a user via the air channel 411 of the suction nozzle 4. The air channel 411 integrates functions of the oil injection and gas suction, such that it does not need to detach the suction nozzle 4 from the atomizing assembly 10 during the oil injection, which is convenient for the user. Before delivery, the atomizing assembly 10 can be assembled as a whole, which can reduce loose individual parts, and thus reduce packaging costs of the atomizing assembly 10 and effectively prevent a loss of components of the atomizing assembly 10.

Figure 10:
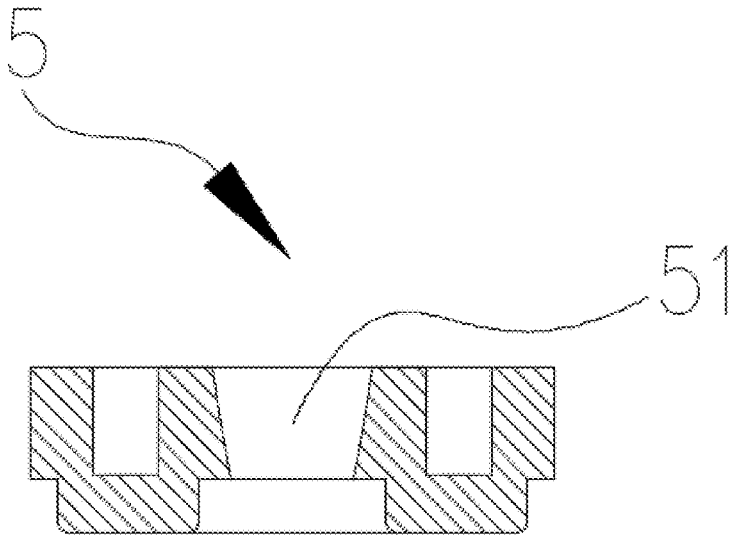
FIG. 10 is a cross-sectional view of a cushion provided in implementations of the disclosure.
Figure 11:
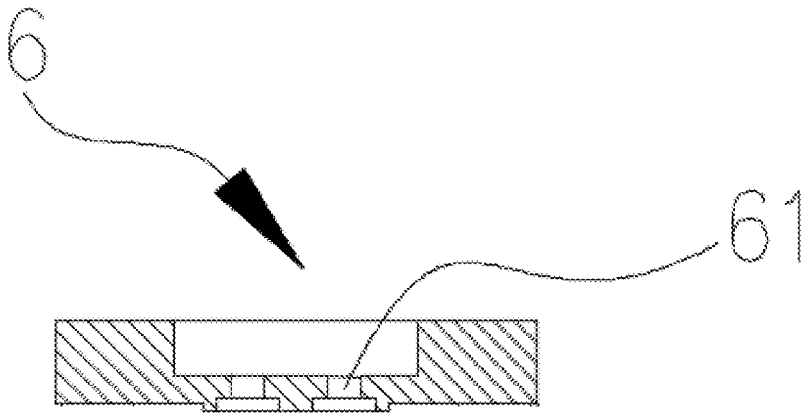
FIG. 11 is a cross-sectional view of a base provided in implementations of the disclosure.

Referring to FIG. 3, FIG. 4, and FIG. 10, FIG. 10 is a cross-sectional view of a cushion provided in implementations of the disclosure.

The cushion 5 and an end of the main body 41 close to the oil cup 1 can be fixedly connected by snap-fitting.

The cushion 5 defines a receiving hole 51, and the protrusion 412 of the air channel 411 extends through the receiving hole 51. An outer periphery of an end of the protrusion 412 close to the oil cup 1 is spaced apart from the inner periphery of the receiving hole 51.

The suction nozzle 4 moves away from the oil cup 1 when oil injection into the oil cup 1 is needed, and the suction nozzle 4 drives the cushion 5 to move away from the oil cup 1. After the protrusion 412 of the air channel 411 is drawn out through the seam 311 of the bottom wall 31, the cushion 5 is spaced apart from the opening-closing member 3, the opening-closing member 3 is in the closed state, and the air channel 411 communicates with the oil cup 1.

The suction nozzle 4 moves toward the oil cup 1 when injecting oil into the oil cup 1 is accomplished, and the suction nozzle 4 drives the cushion 5 to move toward the oil cup 1. The protrusion 412 of the air channel 411 penetrates the seam 311 of the bottom wall 31, and at this moment, an end of the opening-closing member 3 away from the oil cup 1 is received in the receiving hole 51 of the cushion 5, and the outer periphery of the cushion 5 is sandwiched between the main body 41 of the suction nozzle 4 and the main body 11 of the oil cup 1. The air channel 411 is separated from the first receiving cavity 13 of the oil cup 1, and the air channel 411 communicates with the atomizing rod 21, which can facilitate users to suck the atomized gas formed in the atomizing rod 21.

With aid of the cushion 5, the main body 41 can move toward the oil cup 1 after oil injection, and the outer periphery of the cushion 5 is sandwiched between the main body 41 and the main body 11 of the oil cup 1 to absorb an impact between the main body 41 and the main body 11, and thereby prolonging service life of the atomizing assembly 10.

Figure 12:
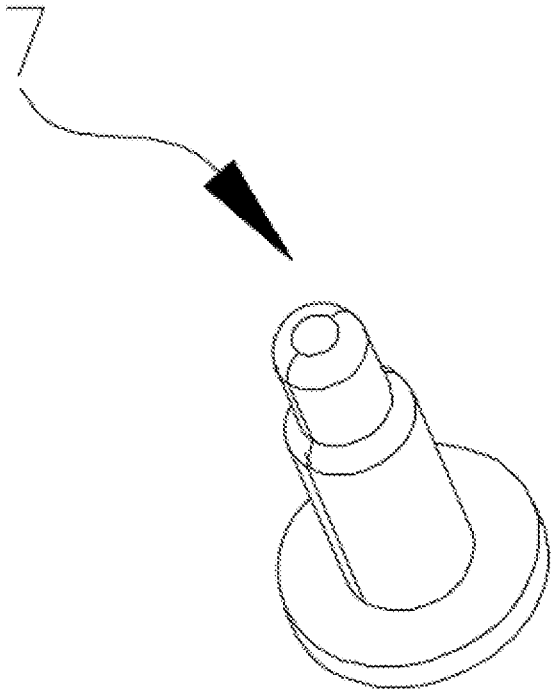
FIG. 12 is a cross-sectional view of an electrode provided in implementations of the disclosure.
Figure 13:
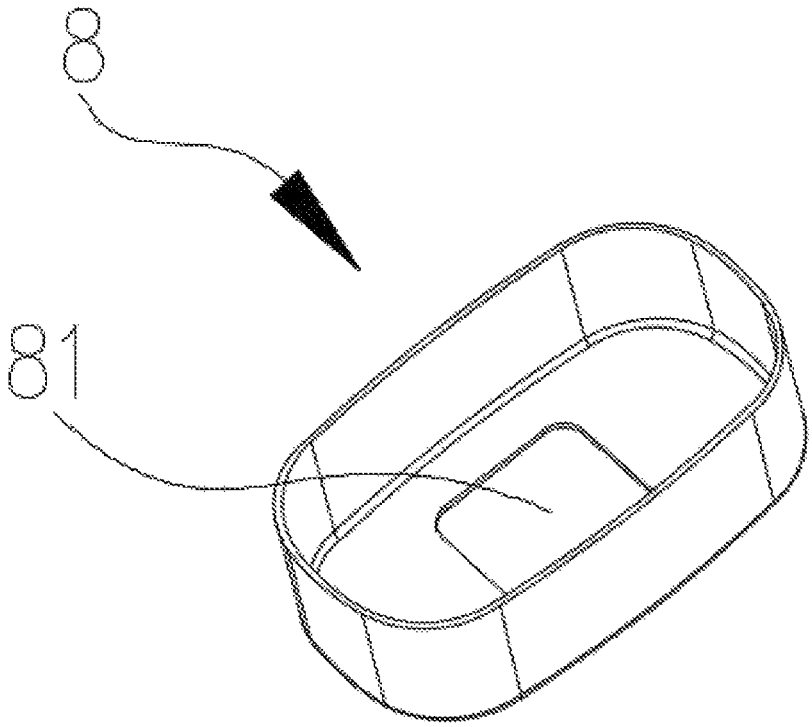
FIG. 13 is a schematic structural view of a fixing sleeve provided in implementations of the disclosure.

Referring to FIG. 1, FIG. 3, FIG. 11, FIG. 12, and FIG. 13, FIG. 11 is a cross-sectional view of a base provided in implementations of the disclosure, FIG. 12 is a cross-sectional view of an electrode provided in implementations of the disclosure, and FIG. 13 is a schematic structural diagram of a fixing sleeve provided in implementations of the disclosure.

The base 6 is disposed in the second receiving cavity 14 of the oil cup 1, an outer periphery of the base 6 abuts against an inner periphery of the second receiving cavity 14, and the connecting portion 12 is partially embedded in the base 6.

The base 6 defines an electrode hole 61. One end of the electrode 7 extends through the electrode hole 61 and is electrically connected with the atomizing core 22, and the other end of the electrode 7 is electrically connected with the cell 202, such that the cell 202 of the power supply assembly 20 can power the atomizing core 22 of the atomizing assembly 10, and therefore, the atomizing device 100 can realize the function of atomizing the liquid to-be-atomized.

The fixing sleeve 8 is sleeved on an outer periphery of the end of the oil cup 1 away from the suction nozzle 4. The fixing sleeve 8 defines a communicating hole 81 facing the electrode hole 61. One end of the base 6 away from the oil cup 1 is embedded in the communicating hole 81. With aid of the fixing sleeve 8, the base 6 is fixed more firmly in the second receiving cavity 14 of the oil cup 1.

Referring to FIG. 3, FIG. 4, and FIG. 7, the following will describe in detail the oil injection of the atomizing assembly 10.

During normal use, the suction nozzle 4 is buckled on the opening of the first receiving cavity 13 of the oil cup 1, the protrusion 412 of the air channel 411 penetrates the seam 311 of the opening-closing member 3, and the opening-closing member 3 is in the open state, such that the air channel 411 communicates with the atomizing rod 21, and thus the atomized gas formed by the atomizing core 22 in the atomizing rod 21 atomizing the liquid to-be-atomized can be sucked by a user. Here, the periphery of the cushion 5 is partially sandwiched between the main body 41 and the main body 11.

When oil injection is needed, a user can press a portion where the suction nozzle 4 abuts against the cushion 5 to make the suction nozzle 4 to drive the cushion 5 to move away from the oil cup 1, such that only the connecting portion 42 is sleeved on the outer periphery of the oil cup 1, while the main body 41 and the cushion 5 fixed in the main body 41 are spaced apart from the oil cup 1. At this moment, the protrusion 412 of the air channel 411 is drawn out through the seam 311 of the opening-closing member 3, the opening-closing member 3 is in the closed state, and the air channel 411 communicates with the first receiving cavity 13 of the oil cup 1. Thus, the liquid to-be-atomized can be injected into the air channel 411 by the user, and the liquid to-be-atomized flows into the first receiving cavity 13 of the oil cup 1 along the air channel 411, such that the oil injection is accomplished.

When the oil injection is accomplished, the user can press the suction nozzle 4 to make the suction nozzle 4 to drive the cushion 5 to move toward the oil cup 1. At this moment, the suction nozzle 4 is buckled on the opening of the first receiving cavity 13 of the oil cup 1, the protrusion 412 of the air channel 411 penetrates the seam 311 of the opening-closing member 3, the opening-closing member 3 is in the open state, and thus the air channel 411 communicates with the atomizing rod 21, such that the liquid to-be-atomized can be atomized by the atomizing core 22 in the atomizing rod 21, allowing the atomized gas to be sucked by the user. The periphery of the cushion 5 is partially sandwiched between the main body 41 and the main body 11.

The oil injecting channel and the air channel 411 are integrally formed via the atomizing assembly 10 provided in the disclosure, such that the oil injection of the atomizing assembly 10 is easy. Moreover, components such as the suction nozzle 4 can be assembled directly with the oil cup 1 when assembling the atomizing assembly 10, thereby reducing a packaging cost of the atomizing assembly 10 before delivery and a loss of components, and thus reducing production costs of the atomizing assembly 10.

The above description are preferred implementations of the disclosure, and it is noted that various improvements and modifications can be made without departing from the principle of the application to those of ordinary skill in the art, and the improvement and the modification are also considered as the protection scope of the disclosure.

What is claimed is:

1. An atomizing assembly configured to atomize liquid to-be-atomized, comprising:

an oil cup configured to store the liquid to-be-atomized;

an atomizer disposed in the oil cup and configured to atomize the liquid to-be-atomized, and the atomizer comprising an atomizing rod and an atomizing core disposed in the atomizing rod;

an opening-closing member covering one end of the atomizing rod away from a bottom of the oil cup and having a closed state and an open state; and a suction nozzle slidably covering the oil cup; wherein the suction nozzle extends through the opening-closing member when the suction nozzle moves toward the oil cup, so that the opening-closing member is in the open state, and the suction nozzle communicates with the atomizing rod; and the suction nozzle is drawn out of the opening-closing member when the suction nozzle moves away from the oil cup, so that the opening-closing member is in the closed state, and the suction nozzle communicates with the oil cup.

2. The atomizing assembly of claim 1, wherein the opening-closing member has a seam and is elastic at the seam, the opening-closing member is in the open state when the suction nozzle extends through the seam, and the seam is closed under an elastic restoring force and the opening-closing member is in the closed state when the suction nozzle is drawn out of the opening-closing member through the seam.

3. The atomizing assembly of claim 2, wherein the opening-closing member has a bottom wall and a peripheral side wall connected with the bottom wall at a periphery of a side of the bottom wall, the bottom wall covers an opening of the atomizing rod away from the bottom of the oil cup, the peripheral side wall is sleeved on a side wall of the atomizing rod, the opening-closing member is in the open state when the suction nozzle extends through the bottom wall into the atomizing rod, and the opening-closing member is in the closed state when the suction nozzle is drawn out of the atomizing rod.

4. The atomizing assembly of claim 3, further comprising a cushion fixedly connected with a side of the suction nozzle close to the opening-closing member, wherein a side of the cushion away from the suction nozzle abuts against the opening-closing member when the suction nozzle extends through the seam, and the side of the cushioning away from the suction nozzle is spaced apart from the opening-closing member when the suction nozzle is drawn out of the opening-closing member.

5. The atomizing assembly of claim 4, wherein the suction nozzle comprises a main body and a connecting portion connected with one side of the main body, the main body covers the oil cup, the connecting portion is sleeved on an outer periphery of the oil cup, and the cushion is disposed in the connecting portion and fixed at one side of the main body close to the connecting portion.

6. The atomizing assembly of claim 5, wherein the connecting portion defines an air channel, the air channel extends through the main body, the main body is provided with a protrusion at the one side of the main body close to the connecting portion, the protrusion is received in the connecting portion and communicates with the air channel; the opening-closing member is in the open state when the protrusion extends into the atomizing rod through the seam, and the air channel communicates with the atomizing rod; and the opening-closing member is in the closed state when the protrusion is drawn out of the opening-closing member through the seam, the protrusion is spaced apart from the bottom wall, and the air channel communicates with the oil cup.

7. The atomizing assembly of claim 1, wherein the oil cup comprises a main body and a connecting portion received in the main body and dividing the main body into a first receiving cavity and a second receiving cavity, the first receiving cavity is configured to receive the liquid to-be-atomized, the connecting portion defines a through hole, and the atomizing rod has one end received and fixed in the through hole and the other end received in the first receiving cavity.

8. The atomizing assembly of claim 7, further comprising a base and an electrode, wherein the base is received and fixed in the second receiving cavity; the base defines an electrode hole, and the electrode extends through the electrode hole and is electrically connected with the atomizing core.

9. The atomizing assembly of claim 8, further comprising a fixing sleeve sleeved on one end of the oil cup away from the suction nozzle; the fixing sleeve defining a communicating hole facing the electrode hole, and the base being partially received in the communicating hole.

10. An atomizing device, comprising an atomizing assembly and a power supply assembly, the power supply assembly being electrically connected with the atomizing assembly to power the atomizing assembly, wherein the atomizing assembly is configured to atomize liquid to-be-atomized and comprises:

an oil cup configured to store the liquid to-be-atomized;

an atomizer disposed in the oil cup and configured to atomize the liquid to-be-atomized, and the atomizer comprising an atomizing rod and an atomizing core disposed in the atomizing rod;

an opening-closing member covering one end of the atomizing rod away from a bottom of the oil cup and having a closed state and an open state; and a suction nozzle slidably covering the oil cup; wherein the suction nozzle extends through the opening-closing member when the suction nozzle moves toward the oil cup, so that the opening-closing member is in the open state, and the suction nozzle communicates with the atomizing rod; and the suction nozzle is drawn out of the opening-closing member when the suction nozzle moves away from the oil cup, so that the opening-closing member is in the closed state, and the suction nozzle communicates with the oil cup.

11. The atomizing device of claim 10, wherein the opening-closing member has a seam and is elastic at the seam, the opening-closing member is in the open state when the suction nozzle extends through the seam, and the seam is closed under an elastic restoring force and the opening-closing member is in the closed state when the suction nozzle is drawn out of the opening-closing member through the seam.

12. The atomizing device of claim 11, wherein the opening-closing member has a bottom wall and a peripheral side wall connected with the bottom wall at a periphery of a side of the bottom wall, the bottom wall covers an opening of the atomizing rod away from the bottom of the oil cup, the peripheral side wall is sleeved on a side wall of the atomizing rod, the opening-closing member is in the open state when the suction nozzle extends through the bottom wall into the atomizing rod, and the opening-closing member is in the closed state when the suction nozzle is drawn out of the atomizing rod.

13. The atomizing device of claim 12, further comprising a cushion fixedly connected with a side of the suction nozzle close to the opening-closing member, wherein a side of the cushion away from the suction nozzle abuts against the opening-closing member when the suction nozzle extends through the seam, and the side of the cushioning away from the suction nozzle is spaced apart from the opening-closing member when the suction nozzle is drawn out of the opening-closing member.

14. The atomizing device of claim 13, wherein the suction nozzle comprises a main body and a connecting portion connected with one side of the main body, the main body covers the oil cup, the connecting portion is sleeved on an outer periphery of the oil cup, and the cushion is disposed in the connecting portion and fixed at one side of the main body close to the connecting portion.

15. The atomizing device of claim 14, wherein the connecting portion defines an air channel, the air channel extends through the main body, the main body is provided with a protrusion at the one side of the main body close to the connecting portion, the protrusion is received in the connecting portion and communicates with the air channel; the opening-closing member is in the open state when the protrusion extends into the atomizing rod through the seam, and the air channel communicates with the atomizing rod; and the opening-closing member is in the closed state when the protrusion is drawn out of the opening-closing member through the seam, the protrusion is spaced apart from the bottom wall, and the air channel communicates with the oil cup.

16. The atomizing device of claim 10, wherein the oil cup comprises a main body and a connecting portion received in the main body and dividing the main body into a first receiving cavity and a second receiving cavity, the first receiving cavity is configured to receive the liquid to-be-atomized, the connecting portion defines a through hole, and the atomizing rod has one end received and fixed in the through hole and the other end received in the first receiving cavity.

17. The atomizing device of claim 16, further comprising a base and an electrode, wherein the base is received and fixed in the second receiving cavity; the base defines an electrode hole, and the electrode extends through the electrode hole and is electrically connected with the atomizing core.

18. The atomizing device of claim 17, further comprising a fixing sleeve sleeved on one end of the oil cup away from the suction nozzle; the fixing sleeve defining a communicating hole facing the electrode hole, and the base being partially received in the communicating hole.

* * * * *